US005897440A

United States Patent [19]

Bae et al.

[11] Patent Number: 5,897,440

[45] Date of Patent: Apr. 27, 1999

[54] NODULE GOLF SHAFT GRIP

[75] Inventors: Sung Wuk Bae, Kyungbuk, Rep. of Korea; David Podrug, Fountain Valley, Calif.

[73] Assignee: Graman U.S.A., Inc., Rancho Santa Margarita, Calif.

[21] Appl. No.: 08/924,374

[22] Filed: Sep. 5, 1997

[51] Int. Cl.[6] ..... A63B 69/36; A63B 53/14

[52] U.S. Cl. ..... 473/201; 473/300; 473/303; 473/316

[58] Field of Search ..... 473/201, 202, 473/203, 204, 205, 206, 297, 298, 299, 300, 301, 302, 303, 558, 559, 564, 549, 551, 552, 316

[56] References Cited

U.S. PATENT DOCUMENTS

| | | | |
|---|---|---|---|
| 1,528,648 | 3/1925 | Armstrong | 473/204 |
| 1,532,679 | 4/1925 | Bradley | 473/204 |
| 3,111,322 | 11/1963 | English | 473/203 |
| 3,779,551 | 12/1973 | Wilson | 473/568 |
| 4,848,746 | 7/1989 | Klink | 473/203 |
| 5,275,407 | 1/1994 | Soong | 473/302 |

*Primary Examiner*—Sebastiano Passaniti
*Attorney, Agent, or Firm*—Graham & James LLP

[57] ABSTRACT

A golf shaft grip which is lightweight, provides sufficient hand to grip adhesion qualities and can be installed without the use of glue, tape or solvents, the grip including grip nodules positioned along the grip end of a golf shaft and attached to the shaft at holes spatially positioned thereabout.

16 Claims, 3 Drawing Sheets

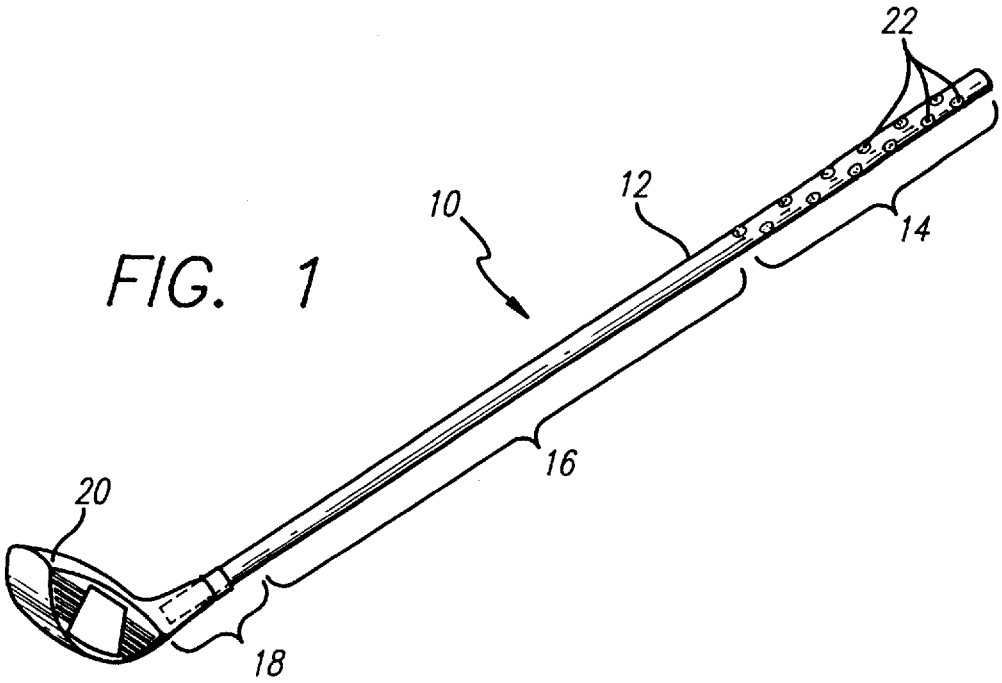
FIG. 1
FIG. 2
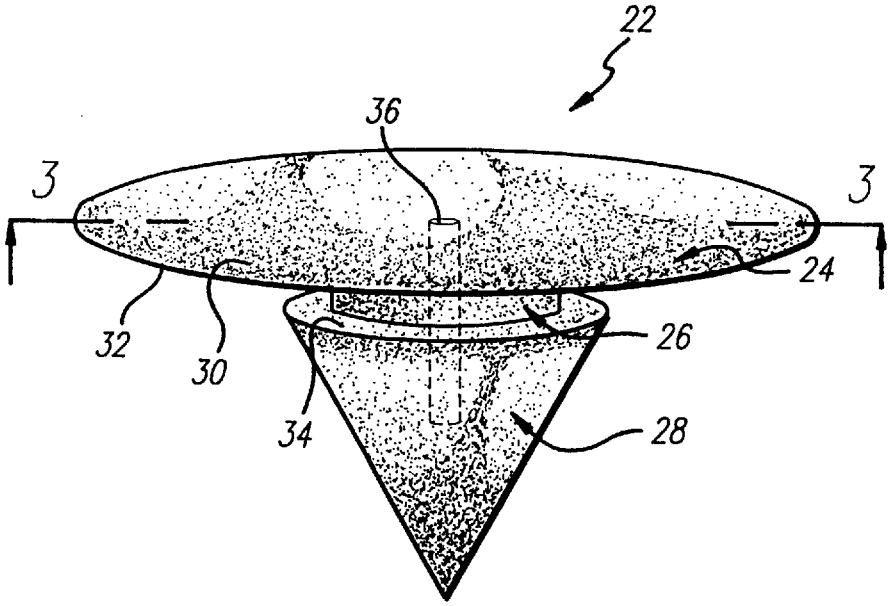

NODULE GOLF SHAFT GRIP

FIELD OF THE INVENTION

The present invention relates to grips for golf shafts. More particularly, the invention relates to a golf shaft grip that provides a lightweight gripping surface which does not require glue, tape or solvents to install.

BACKGROUND

Grips for golf shafts have traditionally been made of leather, synthetic or natural rubber materials which are formed into a tapered tube shape and fitted over or around the grip or butt end of the golf shaft. Typically, the grips are secured to the shaft by glue or tape. Golf shaft performance can be greatly impacted by altering the materials and structure thereof and significant efforts have been directed at reducing the overall weight of the shaft. These efforts have also been directed to reducing the weight of the golf shaft grip and such weight reduction efforts have traditionally focused on modifying the raw materials and manufacturing process for the grips. Practical limitations are encountered, however, when the desire to reduce the weight of the grip is combined with the need to maintain the outside grip dimensions for comfort and feel purposes. A "gripless" golf shaft system exists that eliminates the golf grip entirely, but such a gripless system has resulted in, inter alia, problems of insufficient hand-to-grip adhesion and difficulties in renewing the adhesive qualities of the grip area.

SUMMARY OF THE INVENTION

The present invention is directed to a golf shaft grip system that provides significant weight reduction advantages while still providing a comfortable gripping surface and adequate hand-to-grip adhesion qualities. The present invention provides a gripping surface that is attached to the shaft without the use of glue, tape or solvents and can be easily and quickly replaced without complex tooling.

The present invention provides a gripping surface on a golf club having a shaft with a grip end and a club head end. The shaft grip end includes a plurality of holes spatially placed about the circumference of the shaft and extending through the walls of the grip end. The holes continue from the butt of the shaft down the grip end of the shaft and grip nodules are positioned through the holes. Each of the grip nodules includes a grip portion, a locking portion for removably securing the grip nodules to the shaft, and a stem portion positioned between the grip portion and the locking portion. The stem portion extends through the shaft holes such that the grip portion is positioned on an outer wall of the shaft and the locking portion is positioned on an inner wall of the shaft.

BRIEF DESCRIPTION OF THE DRAWINGS

The present invention is described with reference to the accompanying drawings, in which:

FIG. 1 is a side, perspective view of a golf club which includes a grip end having a nodule golf shaft grip according to a preferred embodiment of the present invention;

FIG. 2 is a side perspective view of a grip nodule shown in FIG. 1;

DETAILED DESCRIPTION OF THE EMBODIMENTS

Figure 3:
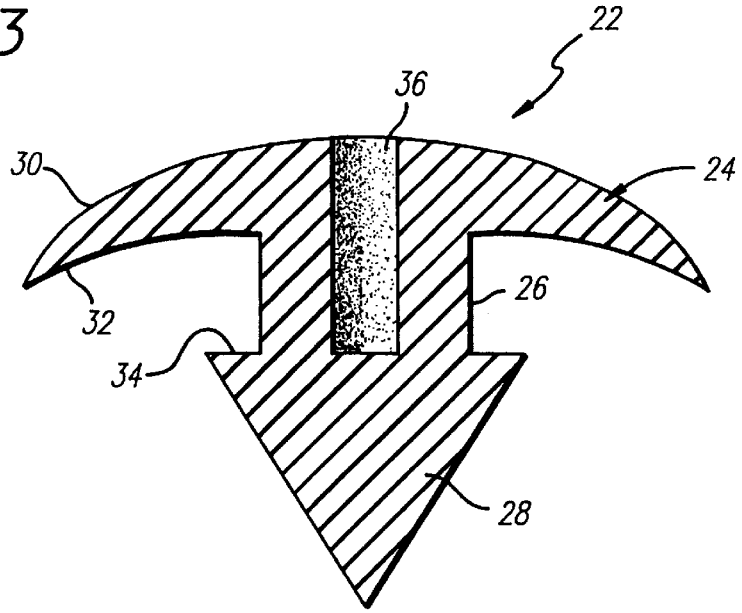
FIG. 3 is a cross-sectional view of the grip nodule of FIG. 2.

FIG. 1 depicts a perspective view of a golf club 10 according to the present invention. The golf club 10 includes shaft 12 in the form of a hollow tubular member and having a grip end 14, a mid-portion 16 and a club head end 18, to which a club head 20 is attached.

The grip end 14 of golf club 10 shown in FIG. 1 includes several grip buttons or nodules 22 spatially positioned thereabout. The grip nodules 22 are positioned about the grip end 14 so as to create a gripping surface for the hands. The grip end 14 may be of a uniform cross-section configuration, as shown in FIG. 1, or may have a generally tapered configuration.

Figure 5:
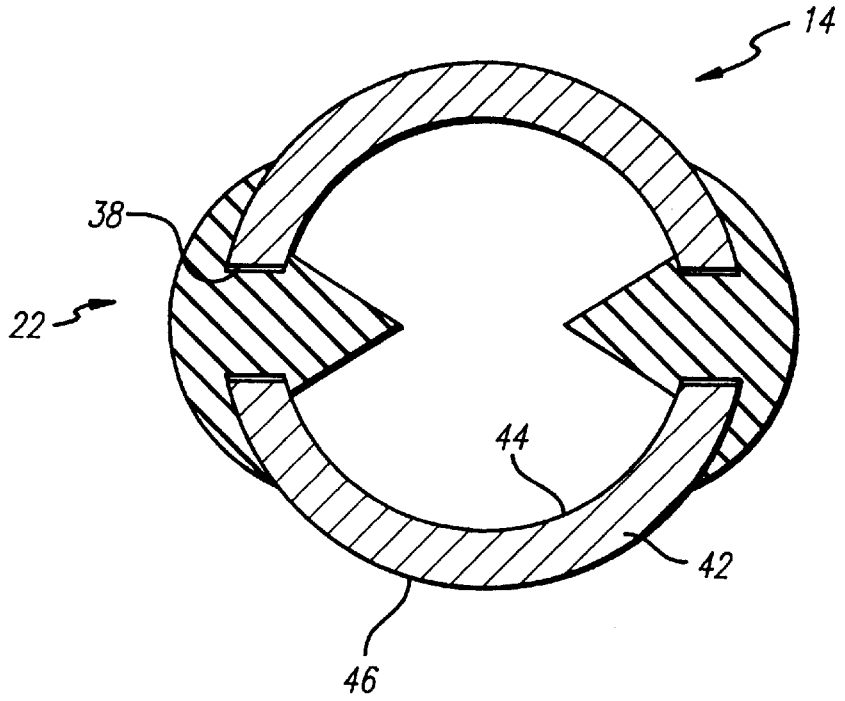
FIG. 5 is a cross sectional view of the preferred embodiment of the present invention taken along plane 5—5 of FIG. 4.

FIGS. 2 and 3 illustrate a preferred embodiment of the grip nodule 22. Grip nodule 22 includes a cap 24, a stem 26 and a locking end 28. Cap 24 has a winged or mushroom-shaped configuration (best shown in FIG. 3) and includes a gripping surface 30 and a shaft surface 32. Gripping surface 30 may have a smooth or rough surface, and has sufficient adhesive or gripping qualities to allow for a firm and comfortable gripping surface. Stem 26 connects cap 24 with locking end 28 and is centrally positioned on the shaft surface 32 of cap 24. The length of stem 26 being at least as great as the width of the wall of grip end 14 (as best shown in FIG. 5). While locking end 28 may take a variety of shape configurations, in the preferred embodiment of FIG. 2, locking end 28 is of a generally funicular shape. Locking end 28 includes locking edge 34 which, after being pushed through a hole in the wall of grip end 14 securely engages with the inner surface of grip end 14. A center hole 36 is provided in grip nodule 22 to, among other things, increase the flexibility of grip nodule 22 and facilitate the placement of grip nodule 22 in grip end 14.

FIG. 3, which is taken along plane 3—3 of FIG. 2, shows a cross-section view of grip nodule 22. Cap 24 has a generally curved appearance, both with respect to gripping surface 30 and shaft surface 32. The utilization of a curved surface for gripping surface 30 increases the comfort for the user, and the curved surface of shaft surface 32 increases the contact surface area between grip nodule 22 and grip end 14. In a preferred embodiment, grip nodule 22 has an overall length of approximately 7.5 mm, cap 24 has a diameter of approximately 10 mm, and stem 26 has a length of approximately 2 mm and a width of approximately 3 mm. The width of stem 26 includes a center hole 36 which has a diameter of approximately 1 mm. The shaft surface 32 of cap 24, as measured form the outer edge of stem 26 to the outer edge of shaft surface 32, has a length of approximately 3.5 mm.

It should be appreciated that the relative dimensions of cap 24 may be varied through a range of dimensions both larger and small than those identified herein, including by a factor of 100% or more. By way of example but not of limitation, the length of gripping surface 30 and shaft surface 32 may be increased by 30%, thereby resulting in greater coverage of the outer portion of grip end 14. Similarly, the length of stem 26 will vary based upon the relative thickness of the wall of grip end 14, and the width of stem 26 and locking edge 34 will vary based upon the diameter of the hole provided in grip end 14. Stem 26 may also be moved so that it is not centrally positioned underneath cap 24. The overall length of cap 24 may be varied to increase or decrease the relative size of the coverage of grip end 14; this coverage affects the overall weight of the shaft 12. This weight savings in the shaft 12 may then be utilized to increase the weight in club head 20.

Figure 4:
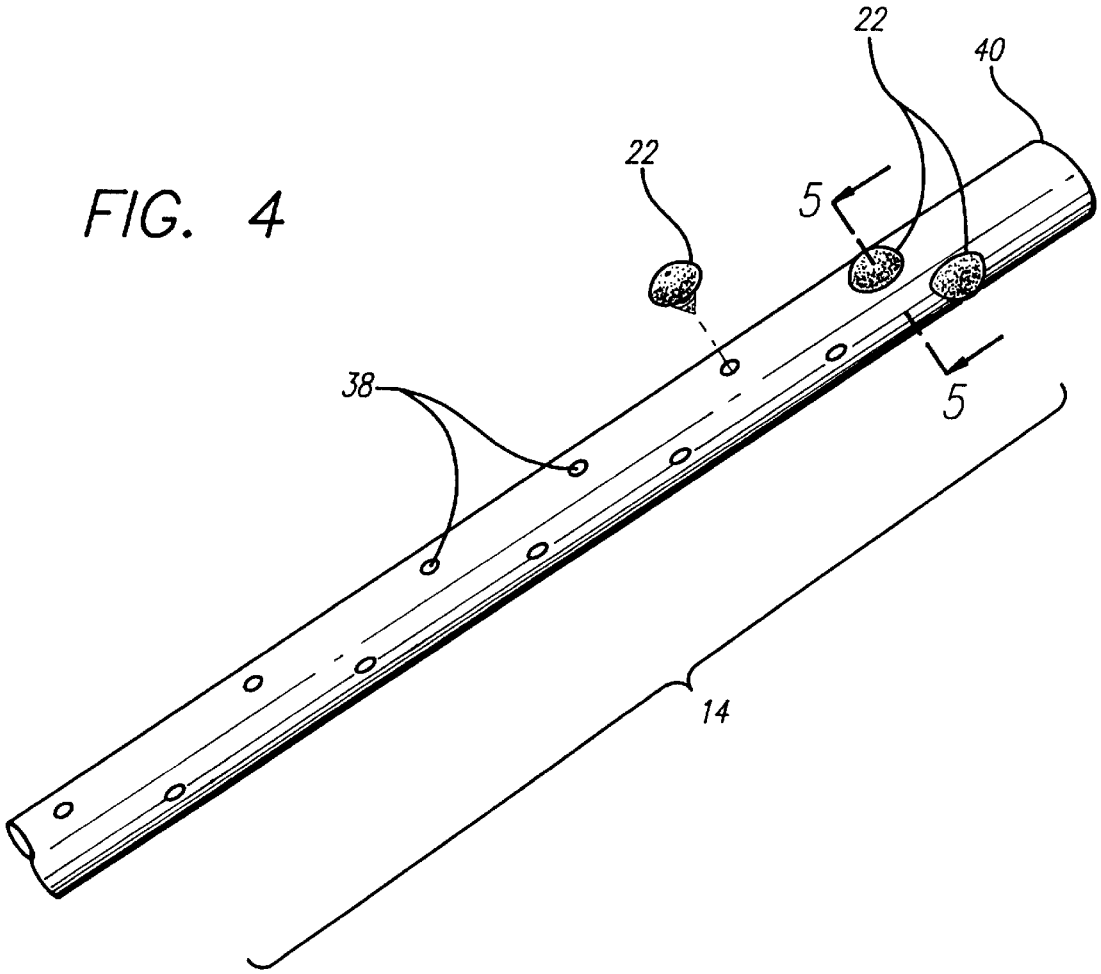
FIG. 4 is a partial, exploded perspective view of a golf shaft and grip nodule in accordance with a preferred embodiment of the present invention.

FIG. 4 is a partial, exploded perspective view of grip end 14 of golf shaft 12 and grip nodules 22, shown both before and after insertion into grip end 14. Stem 26 and locking end 28 of grip nodule 22 are pushed through one of many holes 38 in grip end 14. Holes 38 may be of any size sufficient to accommodate grip nodules 22 and may be positioned in any variety of patterns about grip end 14. In this manner, it is possible to cover less than 100% of the grip end 14 of the shaft but still provide a satisfactory grip surface, thereby reducing the relative weight of shaft. As the number of holes 38 is varied, the number of grip nodules that may be utilized similarly varies. In a preferred embodiment, holes 38 have a diameter of approximately 3 mm and are drilled approximately every 4 cm in four quadrants around grip end 14, with the 0 degree and 180 degree quadrants having holes starting approximately 2.5 cm from the butt end 40 of grip end 14, and the 90 degree and 270 degree quadrants having holes starting approximately 4.25 cm from butt end 40. In this arrangement, less than 50% of the grip end portion of the shaft is actually covered by a gripping surface, but the user is afforded a fully functional golf shaft grip at a substantially reduced weight from the same shaft with a conventional golf grip.

FIG. 5 illustrates a cross-sectional view taken through plane 5—5 of FIG. 4. Grip end 14, which is shown as a hollow tubular member, includes a shaft wall 42 which is defined by an inner surface 44 and an outer surface 46. The width of shaft wall 42 may vary depending upon a number of factors such as the material of which shaft 12 is comprised and the method of manufacture of shaft 12. When the locking end 28 of grip nodule 22 is pushed through hole 38, it is compressed and then expands back to its original shape creating a seal about hole 38 on inner surface 44. Cap 24 then wraps securely about outer surface 46 to create a gripping contact for the user. This interaction eliminates the need for glues or tape to secure the gripping surface to grip end 14. It should be appreciated that the size and shape of cap 24 of grip nodule 22 may be varied. By way of example, but not of limitation, cap 24 may be a rectangular shape, triangular shape or square shape. Grip nodule 22 may be made of any plastic or rubber material, or any other material providing sufficient adhesive and flexibility characteristics. In this regard, grip nodule 22 may be comprised of more than one material, e.g., a softer material for cap 24 to ensure a comfortable grip for the user and a harder material for locking end 28 for secure engagement with grip end 14.

Figure 6:
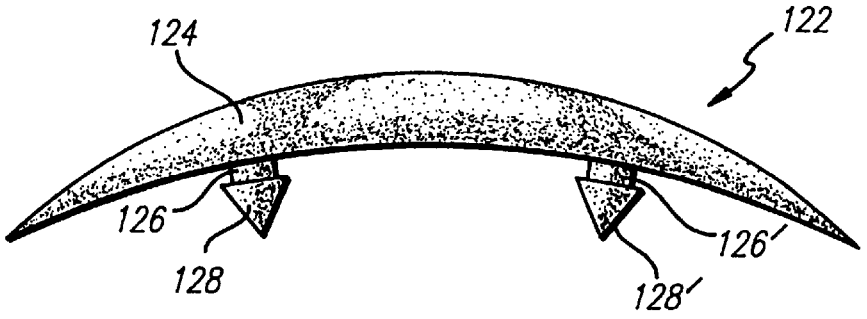
FIG. 6 depicts an alternative embodiment of the grip nodule of the present invention.

FIG. 6 shows an alternative embodiment of a grip nodule 122. Grip nodule 122 includes an enlarged cap 124 which has two stems 126 and 126', and two locking ends 128 and 128'. In the alternative embodiment of FIG. 6, grip nodule 122 will engage with grip end 14 through two sets of holes on the shaft 12. It is also contemplated that the cap 124 may wrap partially or entirely around grip end 14 to be securely engaged with one or more locking ends 128 (and 128'). Thus, cap 124 may take an elongated rectangular shape so that when it is secured to grip end 14 it creates a ring about grip end 14. Still further, the grip nodule may take the form of a thin sheath of plastic, rubber or similar material with a number of locking ends attached to the inside thereof such that the thin sheath may be pulled over butt end 40, down around grip end 14 and then held in place by the locking ends which are pushed into holes 38 in grip end 14.

Having thus described a preferred embodiment of a nodule golf shaft grip system, and various alternative embodiments, it should be apparent to those skilled in the art that certain advantages of the within system have been achieved. It should also be appreciated that various modifications, adaptations, and alternative embodiments thereof may be made within the scope and spirit of the present invention.

What is claimed is:

1. A golf shaft grip on a golf shaft in the form of a hollow tubular member and having a grip end and a club head end, said tubular member having an outer wall surface and an inner wall surface and said grip end including a plurality of holes spatially positioned thereabout and extending therethrough, the golf shaft grip comprising a plurality of grip nodules, each of said grip nodules including a grip portion, removable securing means for removably securing said grip nodules to said grip end, and a stem portion positioned between said grip portion and said securing means, said stem portion extending through said holes such that said grip portion is positioned adjacent said outer wall surface of said golf shaft and said securing means is positioned adjacent said inner wall surface of said golf shaft.

2. A golf club having a shaft in the form of a hollow tubular member including a grip end and a club end, and a club head attached to said club end, wherein said grip end includes:

an inner surface;

an outer surface;

a plurality of openings extending from said outer surface to said inner surface and spatially positioned on said grip end; and a grip nodule positioned within each of said plurality of openings, said grip nodule including a grip portion, a stem portion positioned adjacent said grip portion, and securing means for securing said grip nodule to said golf shaft, said grip portion positioned adjacent said outer surface of said grip end of said shaft and said securing means positioned on the inner surface of said grip end.

3. A golf shaft grip as claimed in claim 1, wherein each of the holes defined in the grip end has a diameter of approximately 3 mm.

4. A golf shaft grip as claimed in claim 1, wherein the holes in the grip end are positioned in first, second, third, and fourth quadrants.

5. A golf shaft grip as claimed in claim 4, wherein at least two of a holes, which are nearest to a butt end of the grip end in the first and the third quadrants, are positioned at a first predetermined distance from the butt end, and wherein the first and the third quadrants are directly adjacent to the second quadrant.

6. A golf shaft grip as claimed in claim 5, wherein some of the holes, which are nearest to the butt end of the grip end in the second and the fourth quadrants, start at a second predetermined distance from the butt end, and wherein the first and the second predetermined distances are different from each other.

7. A golf shaft grip as claimed in claim 1 wherein the grip nodules are made of plastic.

8. A golf shaft grip as claimed in claim 1 wherein the grip nodules are made of leather.

9. A golf shaft grip as claimed in claim 1 wherein the grip portions of the grip nodules are made of a softer material than a material used for the securing means.

10. A golf shaft grip as claimed in claim 1 wherein the grip nodules are made of rubber.

11. A golf shaft grip as claimed in claim 1 wherein each of the grip nodules defines a central nodule hole therein.

12. A golf club as claimed in claim 2, wherein the openings in the grip end are spaced approximately every 4 cm in four quadrants around the grip end.

13. A golf club as claimed in claim 2, wherein the grip end has a butt end, and the grip end having 0 degree and 180 degree quadrants with holes starting approximately 2.5 cm from the butt end.

14. A golf club as claimed in claim 2, wherein the grip end has a butt end, the grip end having 90 degrees and 270 degree quadrants with holes starting approximately 4.25 cm from the butt end.

15. A golf club as claimed in claim 2, wherein the securing means has a funicular shape with a round end connected to a stem portion.

16. A golf club as claimed in claim 2, wherein the securing means includes a locking end.

* * * * *